United States Patent [19]

Passalacqua

[11] Patent Number: 4,953,758

[45] Date of Patent: Sep. 4, 1990

[54] VALVE CONSTRUCTION

[75] Inventor: Vincent Passalacqua, Yonkers, N.Y.

[73] Assignee: Mark-O Industries, Mount Vernon, N.Y.

[21] Appl. No.: 245,025

[22] Filed: Oct. 24, 1988

[51] Int. Cl.[5] ..... B65D 88/54

[52] U.S. Cl. ..... 222/341; 222/383; 137/614.2

[58] Field of Search ..... 222/383, 385, 340, 341, 222/309; 137/614.2; 251/357; 417/550, 555.1

[56] References Cited

U.S. PATENT DOCUMENTS

| | | | |
|---|---|---|---|
| 2,534,504 | 12/1950 | Engstrom | 222/341 X |
| 3,006,282 | 10/1961 | Sisson | 417/555.1 X |
| 3,124,080 | 3/1964 | Sisson | 417/555.1 X |
| 3,240,402 | 3/1966 | Russell | 222/383 |
| 3,907,174 | 9/1975 | Steinman | 222/383 |
| 4,301,826 | 11/1981 | Beckerer | 417/555.1 X |
| 4,330,071 | 5/1982 | Ohlson | 222/383 X |
| 4,762,475 | 8/1988 | Fuchs | 222/383 X |

FOREIGN PATENT DOCUMENTS

| | | | |
|---|---|---|---|
| 0276983 | 8/1988 | European Pat. Off. | 222/383 |

*Primary Examiner*—Joseph J. Rolla

*Assistant Examiner*—Gregory L. Huson

*Attorney, Agent, or Firm*—Darby & Darby

[57] ABSTRACT

A valve for pumping fluid includes a valve body and a valve chamber in the valve body. The valve body has a first end with an entrance passage therethrough. The entrance passage communicates with the chamber to provide a passage for the flow of fluid through the container to the valve chamber. A plunger and a piston are provided. The piston is within the chamber and is connected to the plunger. The piston is moveable in the chamber in response to depression of the plunger. A seat is in the chamber as is a flexible washer. The flexible washer is adjacent to the piston and movable therewith. A biasing spring is provided in the valve body for biasing the washer against the seat. A spout is provided. An exit passage which extends between the spout and the chamber is provided and this exit passage is sealed by the washer when the washer is in the seated position. A normally closed check valve is between the chamber and the entrance passage. Depression of the plunger causes the seal to flex and permits passage of fluid to the exit passage. Release of the plunger creates a decreased pressure in the valve chamber to permit fluid to flow through the entrance passage and open the check valve to refill the chamber.

14 Claims, 1 Drawing Sheet

VALVE CONSTRUCTION

BACKGROUND OF THE INVENTION

The present invention relates generally to a valve construction and, more particularly, to a valve construction which can be used to pump cream, or other similar viscous fluid, at atmospheric pressure from a holding container.

In the past, cream has been removed from containers under commercial conditions in a number of different ways, all of which have had major drawbacks associated with their operation. For example, one such prior art system utilized a simple control valve on a container, the contents of which were maintained under pressure. When the valve was opened, the pressurized cream flowed through the valve. However, installations of this type are expensive as they require pressurizing equipment as well as the necessary safety equipment usually associated with materials under pressure.

In another type of system, a valve which also operated as a pump was used. However, these types of valves required the spout to be mounted on the valve plunger and to move with the same during the pumping action. As a result, spillage occurred because it was difficult to align the moving spout with a container.

Accordingly, a main object of the present invention is to provide a valve for pumping fluids at atmospheric pressure from a holding container which is easy to operate and economical to fabricate.

Another object of the present invention is to provide a pump valve which accurately directs the fluid being pumped into a container with minimal or no spillage.

A further object of the present invention is to provide a valve of the type described which can be used in place of existing valves by simply replacing the same.

BRIEF DESCRIPTION

In a preferred embodiment of the present invention, a valve having a valve body is provided. The valve body has a valve chamber, and a plunger connected to a piston slidably received in the valve chamber. An entrance passage is provided in one end wall of the chamber and an exit passage is provided in the opposite wall.

A flexible seal is provided adjacent the piston and is biased to a position that seals the exit passage. A one-way check valve is provided in the chamber to prevent the flow of fluid outwardly through the entrance passage. A stationary spout, in communication with the exit passage, extends from the valve body. The depression and release of the plunger creates a vacuum in the valve chamber to permit fluid to flow from a container, through the entrance passage into the chamber. As the valve elements return to their normal position, fluid is pumped out the spout.

DETAILED DESCRIPTION OF THE INVENTION

Figure 1:
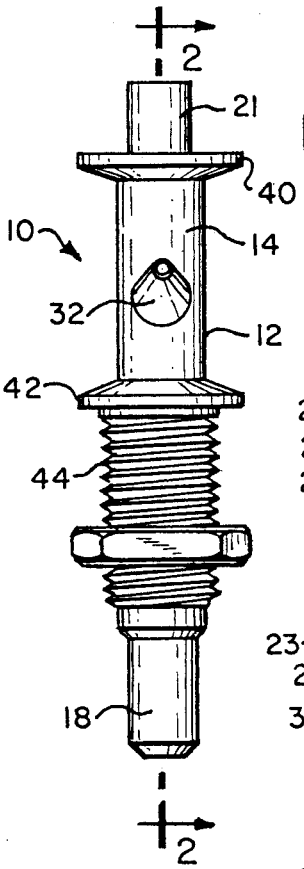
FIG. 1 is a front elevational view of the valve construction of the present invention.
Figure 2:
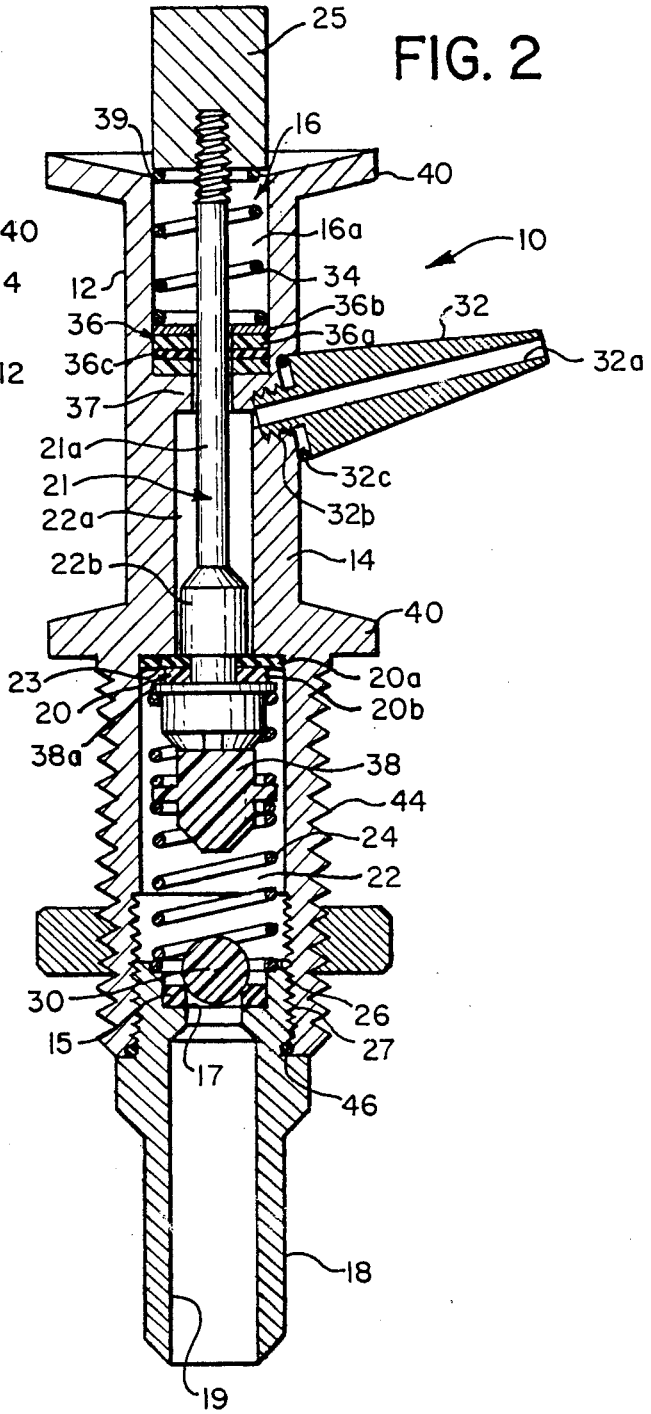
FIG. 2 is a sectional view taken substantially along line 2—2 of FIG. 1 to an enlarged scale.

Referring now to the drawings, the reference numeral 10 designates the valve of the present invention. Valve 10 is adapted to pump fluid at atmospheric pressure from a holding container (not shown) into a receiving container (not shown).

Valve 10 is formed with an elongate valve body 12. Elongate valve body 12 has a circumferential sidewall 14, an upper plunger receiving end 16, and an open, lower material receiving segment 18.

Elongate valve body 12 is provided with a valve chamber 22, and an exit passage **22*a*. The diameter of passage 22*a* is smaller than that of chamber 22 to provide a seat 23 for a flexible seal 20 that seals exit passage 22*a*. Flexible seal 20 has an upper flexible rubber segment 20*a* and a lower rigid segment 20*b*. The diameter of segment 20*a* is slightly larger than the diameter of chamber 22 so the edges of the segment 20*a* effect a wiping action against the chamber walls as the seal moves relative thereto. The rigid segment 20*b* is slightly smaller than the diameter of the chamber 22. An elongate plunger 21 is longitudinally movable within the valve body. The flexible seal 20 surrounds a portion of plunger 21 and moves with said plunger. That is, the plunger includes a depressible button 25 threadedly connected to a shaft 21*a*. The shaft 21*a* is connected to a piston 38 at its lower end. The piston is slidable in the chamber 22 and includes an upper radial flange 38*a***.

The material receiving segment 18 is threadedly connected with the bottom of chamber 22 at 27 and is provided with an entrance passage 19 communicating with the chamber 22. A recess 17 is provided at the top of segment 18 and receives a rubber washer 15 therein.

A ball 30 seats on washer 15 and seals the opening therethrough. Ball 30 serves as a one-way check valve to prevent the flow of fluid outwardly through the passage 19 when the plunger is depressed.

The end of a spring 24 rests in the recess 17 at one end and abuts against flange **38*a* at the other end to bias the piston upwardly and force the seal 20 into sealing engagement with the seat 23**.

A stationary spout 32 has a spout passage **32*a* which is connected with and extends from the valve body sidewall 14 via a stem 32*b*. The axis of spout 32 makes an acute angle with the axis of the valve body to minimize dripping from the spout. A seal 32*c* is provided between the spout and valve body 14**.

The receiving end 16 is provided with an opening **16*a* that slidingly receives the plunger 25. A shoulder 37 is provided between opening 16*a* and passage 22*a*. Seated on the shoulder is a washer 36 that sealingly engages the shaft 21*a* to prevent leakage of the fluid. Actually, washer 36 has middle rubber segment 36*a* and an upper and lower rigid segment 36*b* and 36*c*. A spring 34 is disposed between washer 36 and the bottom surface of the button 25** to prevent the washer from riding upwardly with the shaft.

In a preferred embodiment of the present invention, the valve body 12 is formed of metal. Ball 30 and the lower segment 38 of the piston 21 are formed of plastic.

Valve body 12 is formed with an upper concave circumferential flange 40 to facilitate grasping button 25; and a lower convex circumferential flange 42 which operates in connection with a gasket (not shown) to seal the valve to a container. Valve body 12 is formed with a threaded portion 44 on its outer surface to provide a threaded attachment to a material holding container.

A compressible seal 46 is compressed between lower material receiving segment 18 and the bottom edge of chamber 22.

In the preferred embodiment of the present invention valve body 12 is about 3.75 inches in length, and chamber 22 is about 1.25 inches in length and has a diameter of about 0.455 inches. The outer diameter of seal segment 20a is approximately 0.484 inches and that of segment 20b is 0.391 inches.

In use the valve of the present invention is screwed into a threaded opening in a fluid containing container until the flange 42 compresses the gasket therebetween.

When button 25 is depressed, the fluid below piston 21 is compressed and flows around piston 21 and flexible seal 20 into the exit passage 22a. Ball 30 operates as a one way check valve to prevent fluid from moving out through passage 19. When button 25 is released, spring 24 moves the plunger 21 upwardly creating a vacuum in the chamber 22. Accordingly, the fluid, such as cream, is drawn up into the chamber. The fluid displaces the ball due to the pressure differential to permit the fluid to fill the void. Simultaneously, the upward movement of the plunger forces the fluid above the seal out the spout. In this respect, it is noted that the shaft 21a includes enlarged bottom portion 21b which occupies a substantial portion of the volume of passage 22a to aid in the dispensing of the fluid.

It will be appreciated that the instant specification and claims are set forth by way of illustration and not limitation, and that various modifications and changes may be made without departing from the spirit and scope of the present invention.

What is claimed:

1. A valve for pumping fluid from a container comprising:

a valve body;

a valve chamber having a wall, said chamber being in said valve body;

a first end of said body having an entrance passage therethrough communicating with said chamber to provide a passage for the flow of fluid from a container to said valve chamber;

a plunger;

a piston within said chamber, connected to said plunger and movable therein in response to depression of said plunger;

a seat in said chamber;

flexible sealing means adjacent to said piston and movable therewith, said sealing means including a resilient washer and a rigid washer in axial abutment, said rigid washer being between said resilient washer and said entrance passage, said resilient washer having a diameter slightly larger than the diameter of said valve chamber, said rigid washer having a diameter slightly less than the diameter of said valve chamber;

biasing means in said body of biasing said seal against said seat;

a spout;

an exit passage extending between said spout and said chamber and sealed by said seal when said seal is in the seated position;

and a normally closed check valve between said chamber and said entrance passage;

depression of said plunger causes said resilient washer to flex sufficiently to permit passage of fluid between said seat and said chamber wall to said exit passage, and return of said plunger creates a decreased pressure in said valve chamber to permit fluid to flow through said entrance passage and open said check valve to refill said chamber, said resilient washer wiping the valve chamber wall when said piston returns.

2. The valve of claim 1, wherein the valve body is fabricated from metal.

3. The valve of claim 1, wherein said piston has an upper metallic segment and a lower plastic segment.

4. The valve of claim 1 wherein said flexible washer is fabricated from rubber.

5. The valve of claim 1, in which said valve chamber includes opposed end walls, and said biasing means comprises a spring extending between one of said end walls and said flexible sealing means.

6. The valve of claim 1, in which said plunger comprises a depressible button, and a shaft extending between said button and said piston, and sealing means surrounding said shaft for preventing the leakage of the pumped fluid around said shaft.

7. The valve of claim 1 and further including an O-ring surrounding said spout at the junction of said spout and said valve body to prevent leakage at said junction.

8. The valve of claim 1 wherein the axis of said spout is at an acute angle with respect to the axis of said valve body.

9. The valve of claim 1 wherein a portion of the exterior of said valve body sidewall is threaded to permit threaded engagement of said valve with a container.

10. The valve of claim 1 wherein said valve body includes two circumferential vertically spaced flanges, one of said flanges being adjacent the top of said valve body and the other of said flanges being positioned below said spout.

11. The valve of claim 1 wherein said flexible washer and said rigid washer are planar.

12. The valve of claim 1, wherein said one-way check valve comprises a seat surrounding said entrance passage and a ball normally received in said seat to close said entrance passage.

13. The valve of claim 12, wherein said ball is made of plastic.

14. A valve for pumping fluid from a container comprising:

a valve body;

a valve chamber having a wall, said chamber being in said valve body, a first end of said body having an entrance passage therethrough communicating with said chamber to provide a passage for the flow of fluid from a container to said valve chamber;

a plunger;

a piston within said chamber, connected to said plunger and movable therein in response to depression of said plunger;

flexible sealing means adjacent to said piston and movable therewith, said sealing means including a resilient washer and a rigid washer in axial abutment, said rigid washer being between said resilient washer and said entrance passage, said resilient washer having a diameter slightly larger than the diameter of said valve chamber, said rigid washer having a diameter slightly less than the diameter of said valve chamber;

a spout;

an exit passage extending between said spout and said chamber and sealed therefrom by said flexible sealing means;

and a normally closed check valve between said chamber and said entrance passage;

depression of said plunger causing said resilient washer to flex sufficiently to permit passage of fluid between said resilient washer and said chamber wall to said exit passage, and return of said plunger creating a decreased pressured in said valve chamber, said check valve opening in response to said decreased pressure permitting fluid to flow through said entrance passage and refill said chamber, said resilient washer wiping the valve chamber wall when said piston returns.

* * * * *